US006173913B1

(12) United States Patent
Shafer et al.

(10) Patent No.: US 6,173,913 B1
(45) Date of Patent: Jan. 16, 2001

(54) CERAMIC CHECK FOR A FUEL INJECTOR

(75) Inventors: Scott F. Shafer, Morton; Rajan Tandon, Peoria, both of IL (US); Jayant B. Gondalia, Richmond, VA (US)

(73) Assignee: Caterpillar Inc., Peoria, IL (US)

( * ) Notice: Under 35 U.S.C. 154(b), the term of this patent shall be extended for 0 days.

(21) Appl. No.: 09/383,287

(22) Filed: Aug. 25, 1999

(51) Int. Cl.[7] ..... F02M 59/00; F02M 61/00; F02M 63/00

(52) U.S. Cl. ..... 239/533.2; 239/DIG. 19

(58) Field of Search ..... 239/DIG. 19, 533.2, 239/533.3

(56) References Cited

U.S. PATENT DOCUMENTS

| | | | | |
|---|---|---|---|---|
| 3,773,265 | | 11/1973 | Kent | 239/585 |
| 3,870,233 | | 3/1975 | Wilhelm et al. | 239/15 |
| 4,266,729 | | 5/1981 | Kulke et al. | 239/533.12 |
| 4,328,285 | * | 5/1982 | Siemers et al. | 428/633 |
| 4,499,861 | | 2/1985 | Wiegand et al. | 123/1 A |
| 4,507,394 | * | 3/1985 | Mase et al. | 501/94 |
| 4,526,323 | | 7/1985 | Seifert | 239/453 |
| 4,678,160 | | 7/1987 | Yamada et al. | 251/129.02 |
| 4,681,074 | * | 7/1987 | Ogawa et al. | 123/271 |
| 4,817,873 | | 4/1989 | McKay | 239/397.5 |
| 4,824,026 | | 4/1989 | Tamura et al. | 239/707 |
| 4,835,123 | * | 5/1989 | Bush et al. | 501/104 |
| 4,981,267 | * | 1/1991 | Scott | 239/533.3 |
| 5,020,500 | * | 6/1991 | Kelly | 239/533.2 |
| 5,076,244 | | 12/1991 | Donaldson | 123/527 |
| 5,095,872 | | 3/1992 | Kawamura | 123/254 |
| 5,337,961 | | 8/1994 | Brambani et al. | 239/397.5 |
| 5,348,229 | | 9/1994 | Wood et al. | 239/397.5 |
| 5,607,106 | | 3/1997 | Bentz et al. | 239/88 |
| 5,649,571 | | 7/1997 | Miyahara et al. | 139/435.5 |
| 5,740,969 | | 4/1998 | Hoffmann et al. | 239/533.2 |
| 5,755,261 | * | 5/1998 | Fukuzawa et al. | 137/625.17 |

* cited by examiner

*Primary Examiner*—Andres Kashnikow
*Assistant Examiner*—Davis Hwu
(74) *Attorney, Agent, or Firm*—Eric M. Bram

(57) ABSTRACT

A fuel injector nozzle assembly comprises a nozzle defining a guide bore, a fuel pressurization chamber, a seat, and a nozzle orifice. A check valve member has an impact area and a guide portion. The guide portion slides within the guide bore to allow the check valve member to slide between an open position and a closed position. In the open position the fuel pressurization chamber is in fluid communication with the nozzle orifice. In the closed position the impact area of the check valve member is pressing against the seat of the nozzle, and the check valve member is blocking fluid communication between the fuel pressurization chamber and the nozzle orifice. The check valve member comprises a ceramic material having a coefficient of thermal expansion $\alpha > 8 \times 10^{-6}/°$ C. when averaged over a temperature range of 0° C. to 300° C.

24 Claims, 4 Drawing Sheets

FIG-3
THERMAL EFFECT ON TIP/CHECK CLEARANCES & LIFT
$\delta T = 100$ C
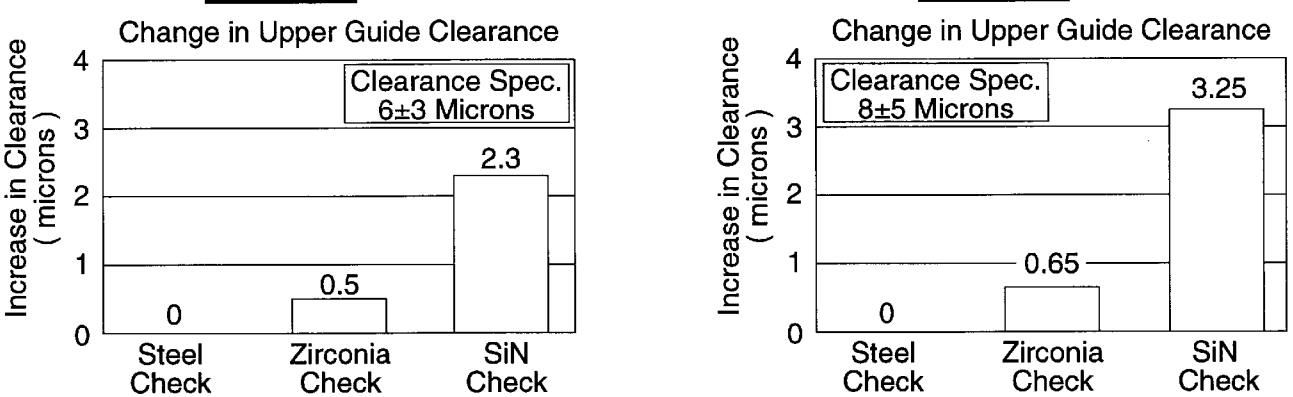
FIG-3A
FIG-3B
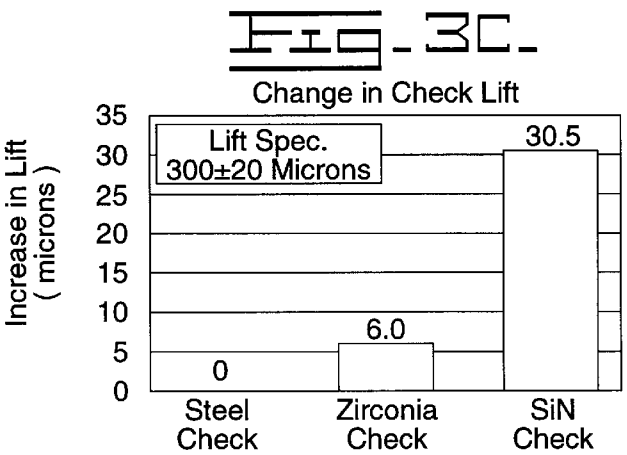
FIG-3C
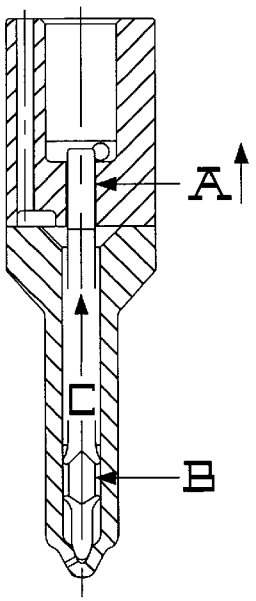

CERAMIC CHECK FOR A FUEL INJECTOR

TECHNICAL FIELD

The present invention relates generally to fuel injector nozzle assemblies, and more particularly to materials used in manufacture of check valve components used in fuel injector nozzle assemblies.

BACKGROUND

Modern fuel injectors often have a nozzle portion in which a check or needle valve is used to alternatively start or stop fuel injection. Often the check valve comprises a check valve member biased against the inner wall of the nozzle in such a way as to fluidly isolate the fuel injector orifices from the fuel chamber.

The bias keeping the check valve closed can be provided by a spring, hydraulic pressure pushing against the check valve member, other biasing means, or a combination of these. Fuel injection usually commences when fuel pressure in the fuel chamber surrounding the check valve member becomes great enough to overcome the bias keeping it closed. This can be accomplished by increasing the fuel pressure in the fuel chamber, decreasing the closing bias, or a combination of both.

Accordingly, the check valve member is subjected to high forces during operation. The check valve member is generally sliding against one or more guide surfaces in the nozzle and also impacts and presses against the inner wall of the nozzle, for example a seat in the nozzle. Wear of the check valve member and the nozzle, and accordingly their expected lifetimes, are to a large degree dependent on the friction coefficients of their materials. There is friction on the check valve member as it slides against the nozzle guide surfaces and the seat, or at other areas where the valve member impacts against the nozzle wall. The greatest wear on the check valve member usually occurs where the check valve member impacts the inner wall of the nozzle to close off the orifices.

There have been many attempts to incorporate ceramic materials into fuel injector nozzles and nozzle valve assemblies for various reasons, not necessarily to reduce friction. Sometimes the lighter weight of ceramic materials is found desirable, and sometimes the corrosion resistant properties of ceramic materials are desired.

However, there have been problems associated with trying to use ceramic check valve members in fuel injectors. For example, because of differences in coefficients of expansion with temperature between ceramic materials and the metallic components of the fuel injector (for example 52100 steel) during fuel injector operation, the operating characteristics of a fuel injector using ceramic parts can change dramatically with temperature. For example, a significant change in the operating temperature can lead to unacceptably high changes in guide clearance and in check lift (the distance between the check valve member and the nozzle seat when the check valve member is in opened position).

Many approaches to using ceramic materials in nozzle assemblies have not addressed the possible problems caused by differing coefficients of expansion. For example, U.S. Pat. No. 5,409,165 to Caroll, III et al., issued Apr. 25, 1995, concentrates on the wear resistant properties of ceramics, and teaches a wear resistant plunger assembly for a fuel injector and discusses the possibility of using ceramic material for the plunger tip. As another example, the Bosch Corp. of Germany is believed to use a known diamond-like coating (DLC) similar to ceramics on an upper guide portion of a check valve member in a fuel injector.

But there have been attempts to work around the thermal expansion problem. For example, U.S. Pat. No. 5,607,106 to Bentz et al., issued Mar. 4, 1997, teaches a fuel injector needle valve assembly including a silicon nitride needle tip operating in conjunction with a valve seat subassembly in the nozzle made from a combination of metal and ceramic. Adding ceramic material to the valve seat subassembly may lower the coefficient of thermal expansion of the valve seat subassembly to one similar to that of the ceramic needle tip, thus reducing gross heat expansion differences between the nozzle and the needle tip portions. However, adding ceramic materials to the nozzle to match thermal expansion characteristics of a ceramic check valve member complicates the manufacturing process considerably and introduces additional weaknesses to structural integrity of the nozzle assembly. This makes the fuel injector more costly to manufacture and more likely to fail over time.

DISCLOSURE OF THE INVENTION

In one aspect of the invention, a fuel injector nozzle assembly comprises a nozzle and a check valve member. The nozzle defines a guide bore, a fuel pressurization chamber, a seat, and a nozzle orifice. The check valve member has an impact area and a guide portion. The guide portion slides within the guide bore to allow the check valve member to slide between an open position and a closed position. In the open position the fuel pressurization chamber is in fluid communication with the nozzle orifice. In the closed position the impact area of the check valve member is pressing against the seat of the nozzle, and the check valve member is blocking fluid communication between the fuel pressurization chamber and the nozzle orifice. The check valve member comprises a ceramic material having a coefficient of thermal expansion $\alpha > 8\times10^{-6}/°$ C. when averaged over a temperature range of 0° C. to 300° C.

In another aspect of the invention, a fuel injector has a fuel injector nozzle assembly comprising a nozzle and a check valve member. The nozzle defines a guide bore, a fuel pressure chamber, a seat, and a nozzle orifice. The check valve member has an impact area and a guide portion slidably disposed in the guide bore between an open position and a closed position. In the open position the fuel pressure chamber is in fluid communication with the nozzle orifice. In the closed position the impact area of the check valve member is pressing against the seat of the nozzle and the check valve member is blocking fluid communication between the fuel pressure chamber and the nozzle orifice. The check valve member comprises a ceramic material having a coefficient of thermal expansion $\alpha > 8\times10^{-6}/°$ C. when averaged over a temperature range of 0° C. to 300° C.

BRIEF DESCRIPTION OF THE DRAWING

FIG. 3 illustrates dimensional variations with temperature within a fuel injector using various materials for the check valve member.

DETAILED DESCRIPTION OF PREFERRED EMBODIMENTS

Figure 1:
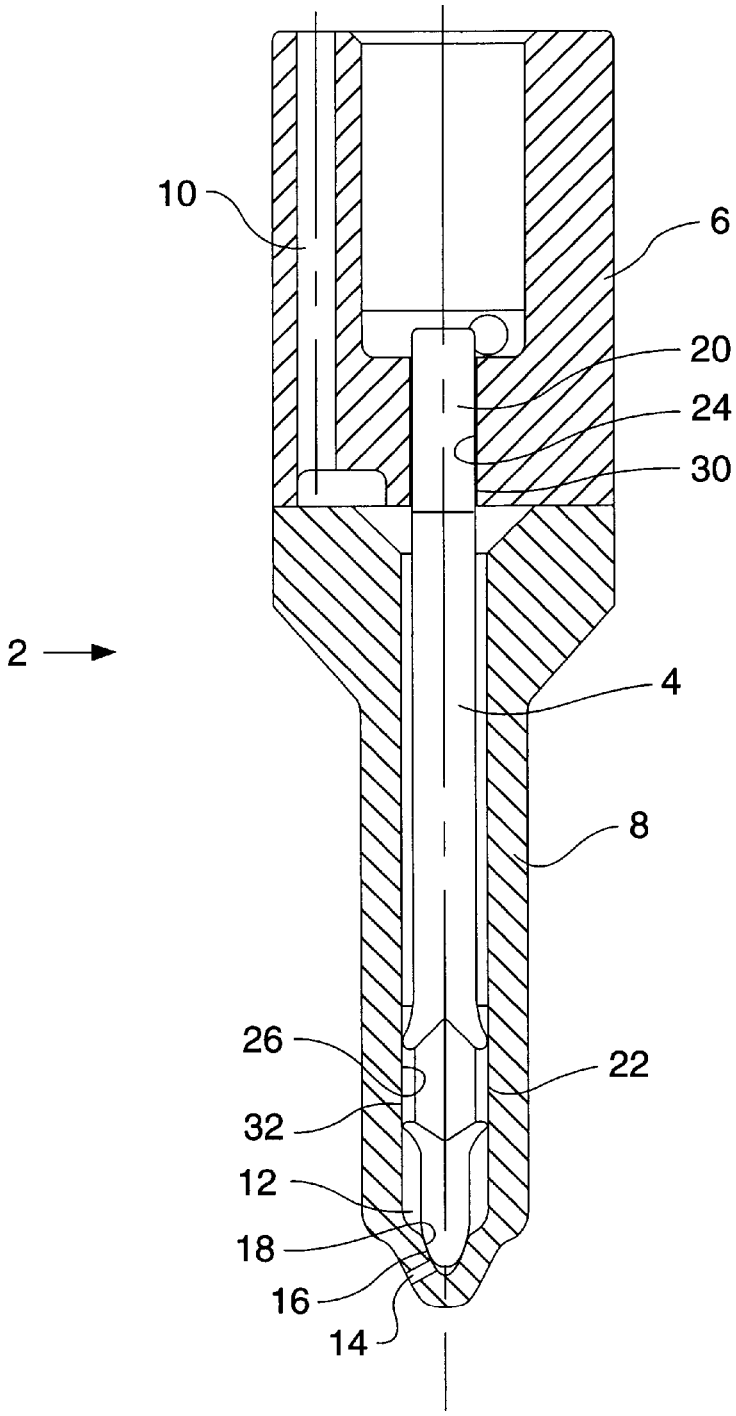
FIG. 1 is a diagrammatic sectioned side view of one embodiment of a fuel injector nozzle assembly according to the invention.

Referring now to a fuel injector nozzle assembly 2 according to one embodiment of the invention, shown in FIG. 1, fuel injector nozzle assembly 2 is a portion of a fuel injector. The various components shown are positioned as they would be just prior to an injection event. In particular, nozzle assembly 2 includes a needle or check valve member 4, and a nozzle 8 including a nozzle sleeve or if upper nozzle component 6 that is generally held within a fuel injector casing (not shown).

During an injection event, pressurized fuel travels through a nozzle supply passage 10 defined by the upper nozzle component 6 to a fuel pressurization chamber 12. The upper nozzle component 6 includes a biasing means (not shown), which can be a spring, hydraulic fluid at high pressure, or any other method of biasing the check valve member 4 with a check closing force toward its closed position. The check valve member 4 is moveable between an upward (relative to FIG. 1), open position (not shown) in which one or more nozzle orifices 14 are open, and a downward, closed position (illustrated in FIGS. 1 and 2) in which the nozzle orifice 14 is closed.

In the fuel injector nozzle assembly 2 shown in FIG. 1 the check valve member 4 does not need to directly cover the nozzle orifice 14 when the check valve member 4 is in the closed position. Rather, when the check valve member 4 is in the closed position, an impact area 16 of the check valve member 4 is seated at a seat 18 of the nozzle 8 located above the nozzle orifice 14. Various embodiments using the invention can have one, some, or all of their nozzle orifices 14 either on or off the seat area 18 itself.

The check valve member 4 includes an upper guide portion 20 and a lower guide portion 22. The upper guide portion 20 is slidably disposed within an upper guide bore 24 defined by the upper nozzle component 6. Similarly, the lower guide portion 22 is slidably disposed within a lower guide bore 26 defined by the nozzle 8. The lower guide portion 22 also defines a plurality of partial cylindrical passages 28 arranged about the check valve member 4 to allow fuel to flow freely within the fuel pressurization chamber 12.

In the embodiment of FIG. 1 the nozzle 8 is made of 52100 steel, but nozzles, nozzle tips, bodies, guides, or other components in other embodiments can be made of other structurally suitable steels including direct hardened, carburized hardened, nitrided, carbonitrided or other heat treated or processed steels.

Figure 2:
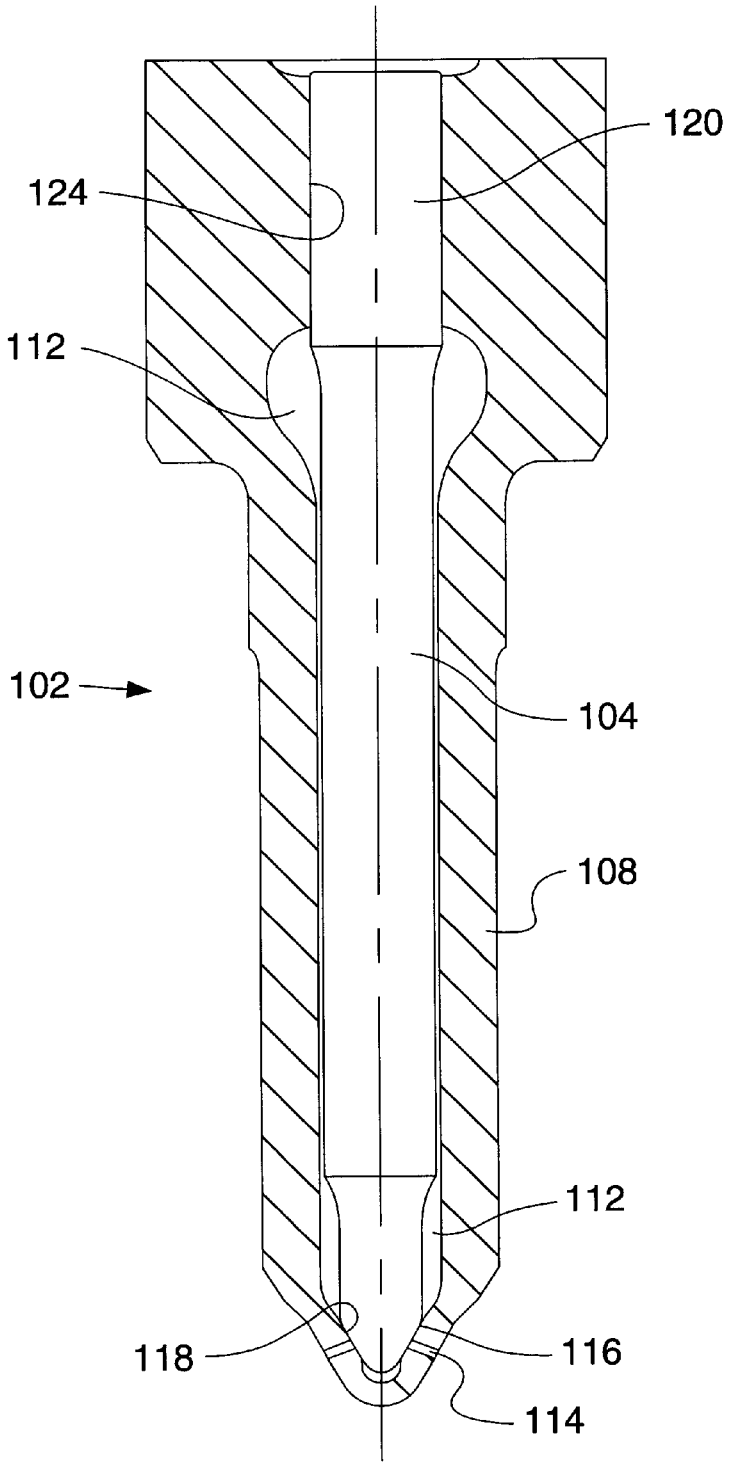
FIG. 2 is a diagrammatic sectioned side view of another embodiment of a fuel injector nozzle assembly according to the invention.
Figure 2A:
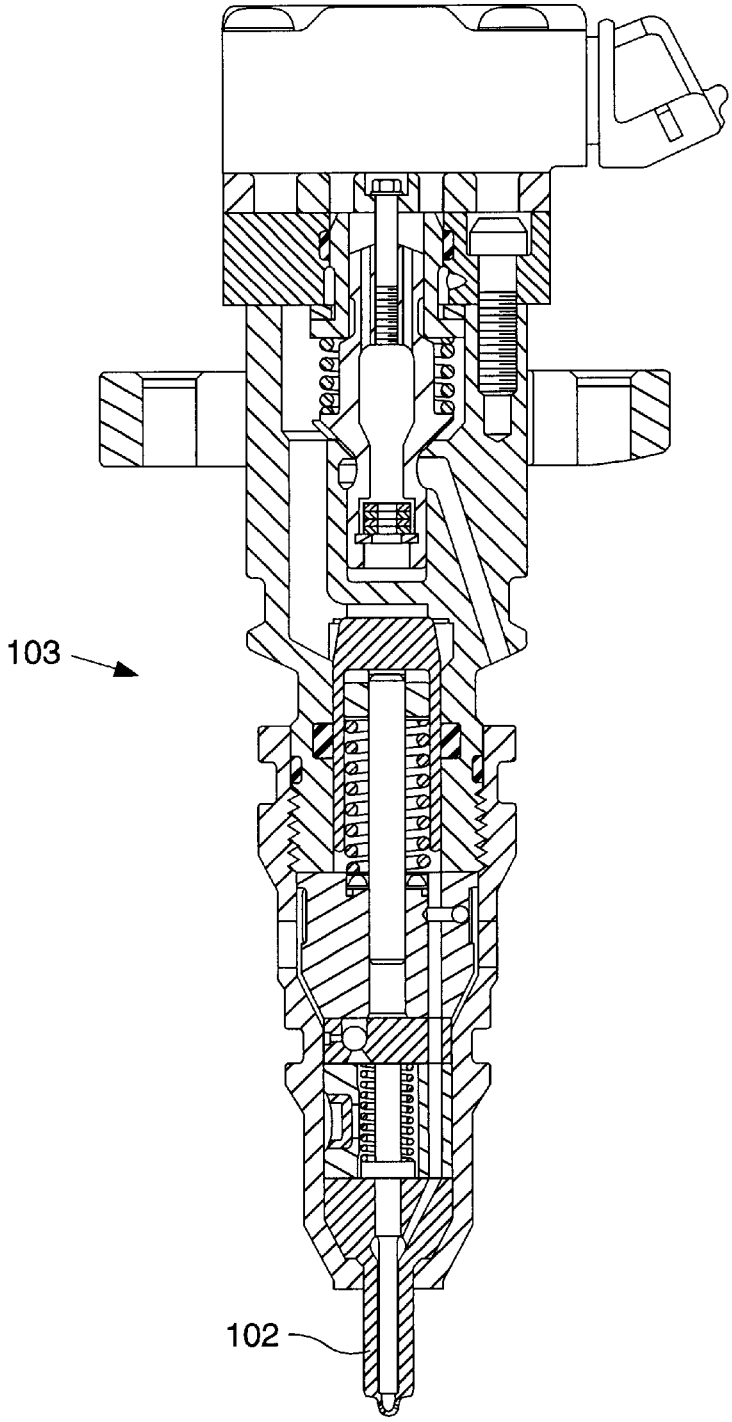
FIG. 2A is a diagrammatic sectioned side view of a fuel injector comprising the fuel injector nozzle of FIG. 2.

FIGS. 2 and 2A show another embodiment of a fuel injector nozzle assembly 102 with a check valve member 104 according to the invention. The fuel injector nozzle assembly 102 is comprised by a fuel injector 103 and includes a nozzle 108, a fuel pressurization chamber 112, and a seat 118. The nozzle 108 defines a guide bore 124. The check valve member 104 is made using the same ceramic materials as in the first embodiment. The check valve member 104 defines an impact area 116 and includes a guide portion 120 slidably disposed within the guide bore 124. The impact area 116 contacts the seat 118 of the nozzle 108 when the check valve member 104 is in closed position. At the closed position orifices 114 are blocked from receiving fuel from the fuel pressurization chamber 112.

Generally the embodiment of FIG. 2 is similar to the embodiment shown in FIG. 1, but with a few structural differences. For example, the embodiment shown in FIG. 2 has a single guide portion. Of course, the illustrated embodiments of FIGS. 1 and 2 are just two of the many possible structural configurations for using the invention in a fuel injector.

INDUSTRIAL APPLICABILITY

To reduce seat and guide wear, frictional resistance, performance variability, and dynamic loading, applicants began searching for a material for the check valve member 4 that would have the low friction characteristics of ceramics, that would be tough and nonbrittle, and yet would have thermal expansion and hardness characteristics close to that of steel. That way the advantages of ceramics could be utilized while minimizing the thermal expansion variation problems discussed above.

Accordingly, a thermal expansion coefficient $\alpha$ is desired that, when averaged over a possible operating range for fuel injectors, is greater than 8 parts per million per degree Celsius ($8\times10^{-6}$/° C.), and preferably greater than $9\times10^{-6}$/° C. In experimenting with various materials, applicants measured thermal expansion over a range of 0° C. to 300° C. Applicants have recited that temperature range in the claims in order to define the ceramic material of the invention with specificity, but of course the invention can be practiced at temperatures outside that range as well.

Conventional materials proved to be unsuitable. For example, if the check valve member 4 in FIG. 1 were made of a silicon nitride ceramic the change in an upper guide clearance 30 and a lower guide clearance 32 with a 100 degree Celsius temperature change would be 2.3 microns and 3.25, respectively, as shown in FIGS. 3A and 3B, respectively. The change in check lift with a 100 degree Celsius temperature change if the check valve member 4 is made of a silicon nitride ceramic would be 30.5 microns, as shown in FIG. 3C. Of course, the exact values of variation with temperature change will vary with the structure of the fuel injector, but generally these differences in guide clearances and in check lift are unacceptably high for very good fuel injector performance.

Accordingly, applicants began experimenting with check valve members comprising zirconia-ceramics. Zirconia-ceramics have the highest toughness at room temperature of all engineering ceramics. With its excellent surface smoothness, zirconia has been used for pump parts. However, its suitability for use in fuel injectors was not hitherto anticipated. Applicants' experiments have shown however, that not only do certain zirconia-ceramics have excellent surface smoothness, and therefore low coefficients of friction, but that certain zirconia-ceramics can have thermal expansion coefficients very close to that of steel.

Applicants experimented with zirconia-ceramic materials doped with various percentages of different elements, to obtain various types of stabilized zirconia (SZ) ceramics. Some of these, such as alumina-stabilized zirconia (AlSZ) ceramics, were found to be unsuitable because they had poor stability when mixed with various types of fluids, including water, that could be found in engine fuels of various quality. A yttria-stabilized ceramic was found to undergo significant strength degradation when exposed to high temperatures. Additionally, yttria-stabilized and alumina-stabilized ceramics were found to be generally too hard compared with steel (for example 52100 steel, which has a hardness of about 6 GPa=$6\times10^{9}$ pascals). This could lead to additional wear of the steel nozzle portions. For best results, therefore, it is preferred that the check valve member 4 uses a ceramic material of a hardness below 13 GPa, and more preferably below 12 GPa.

Applicants found that it is possible to choose ceramic materials with the desired characteristics, including coefficient of thermal expansion and hardness, that meet the above criteria. For example, ceria-stabilized zirconia-ceramic (Ce-TZP) as supplied by the Ferro Corp. material supply company, and magnesia-stabilized zirconia-ceramics (Mag-TZP) as supplied by the Coors Ceramic Co., Kyocera Industrial Ceramics, Kennametal, and Carpenter material supply companies, exhibit thermal expansion coefficients $>9\times10^{-6}/°$ C. and hardness less than 11 GPa. Any ceramic materials of the thermal expansion coefficient and other criteria recited in the claims may be used in practicing the invention, but the illustrated embodiments use magnesia-stabilized and ceria-stabilized zirconia-ceramics (Mag-TZP and Ce-TZP).

Aside from meeting the thermal expansion and hardness criteria, Mag-TZP and Ce-TZP also have good stability even when there is water or oil mixed in with the fuel, in contrast to alumina-stabilized zirconia-ceramics and most yttria-stabilized ceramics. Further, the elastic modulus of ceria-stabilized zirconia-ceramics and of magnesia-stabilized zirconia-ceramics is very close to that of steel, which may be advantageous, in contrast to the considerably higher elastic modulus of an alumina-stabilized zirconia-ceramic.

In contrast to the results using silicon nitride ceramic, using a Mag-TZP or Ce-TZP ceramic check valve member 4 in the embodiment of FIG. 1 results in only a 0.5 micron upper guide clearance variation, a 0.65 micron lower guide clearance variation, and a 6 micron check lift variation with a 100 degree Celsius temperature change, as illustrated in FIGS. 3A, 3B, and 3C, respectively.

In operation, referring once again to FIG. 1 for example, once the fuel pressure in the fuel pressurization chamber 12 exceeds the check closing force exerted by the biasing means, it will push the check valve member 4 off the seat 18, allowing high pressure fuel to pass through the nozzle orifices 14, and into an engine combustion chamber for example. While the check valve member 4 is moving toward its open position it is subject to frictional forces along its upper guide portion 20 and its lower guide portion 22.

When the fuel pressure in the fuel pressurization chamber 12 once again becomes lower than the valve opening pressure force exerted by the biasing means, the check valve member 4 moves once again to its closed position. In doing so it generally slams its impact area 16 against the seat 18 of the nozzle 8, at which time both the check valve member 4 and the nozzle 8 are subject to both impact and frictional forces. Further, while the check valve member 4 is moving toward its closed position it is subject to frictional forces along its upper guide portion 20 and its lower guide portion 22.

The zirconia-ceramic check valve member 4 of the invention, for instance the Mag-TZP ceramic check valve member 4 or Ce-TZP check valve member 4 of the embodiment of FIG. 1, has much improved wear resistance and a reduced coefficient of friction. Because of this the zirconia-ceramic check valve member 4 provides improved wear resistance for both the check valve member 4 and the nozzle 8. This helps keep opening and closing operation of the valve consistent at full, partial, and throttling lift pressures. Thus, performance variability is reduced and engine performance is improved.

As explained above, making the zirconia-ceramic check valve member 4 using a material having a coefficient of thermal expansion similar to that of steel, for example 52100 steel ($\alpha\approx13\times10^{-6}/°$ C.) as used in the illustrated embodiments, also reduces performance variability because the differences in guide clearances and in check lift distance are reduced when the temperature of the fuel injector changes.

The zirconia-ceramic check valve member 4 can also withstand the very high temperatures often found in fuel injectors. Also, the zirconia-ceramic check valve member 4 has lower mass, and hence reduces dynamic load (impact load) of the check valve member 4 against the fuel injector body or nozzle part. This improves structural reliability of the nozzle assembly 2 and associated structures, especially the seat 18 of the nozzle 8, as well as the impact area 16 of the check valve member 4.

It should be understood that the above description is intended only to illustrate the concepts of the present invention, and is not intended to in any way limit the potential scope of the present invention. For example, the illustrated embodiments are of valves biased toward their closed positions. Other valve embodiments using the invention could be biased toward their opened positions, with hydraulic pressure or other means being used to close the valves.

As another example, the impact areas of a check valve member can engage seats at the opened position instead of, or as well as at the closed session. Also, the check valve members 4, 104 in the illustrated embodiments may be descriptively named "needle valves" because of their needle-like shapes, but the recited "check valve members" of the claims can be otherwise shaped members that move within the nozzle to close off fuel injection, even if they don't resemble needles at all.

Similarly, various other modifications could be made to the illustrated embodiments without departing from the intended spirit and scope of the invention as defined by the claims below.

We claim:

1. A fuel injector nozzle assembly comprising:

a nozzle defining a guide bore, a fuel pressure chamber, a seat, and a nozzle orifice; and a check valve member having an impact area and a guide portion slidably disposed in the guide bore between an open position in which the fuel pressure chamber is in fluid communication with the nozzle orifice and a closed position in which the impact area of the check valve member is pressing against the seat of the nozzle and the check valve member is blocking fluid communication between the fuel pressure chamber and the nozzle orifice; and the check valve member comprising a ceramic material having a coefficient of thermal expansion $\alpha>8\times10^{-6}/°$ C. when averaged over a temperature range of 0° C. to 300° C.

2. The nozzle assembly of claim 1, wherein at least one of the guide portion and the impact area of the check valve member comprises at least one of a magnesia-stabilized zirconia-ceramic material and a ceria-stabilized zirconia-ceramic material.

3. The nozzle assembly of claim 2, wherein both the guide portion and the impact area of the check valve member comprise the at least one of the magnesia-stabilized zirconia-ceramic material and the ceria-stabilized zirconia-ceramic material.

4. The nozzle assembly of claim 2, wherein the check valve member comprises the magnesia-stabilized zirconia-ceramic material.

5. The nozzle assembly of claim 4, wherein at least the impact area of the check valve member comprises the magnesia-stabilized zirconia-ceramic material.

6. The nozzle assembly of claim 5, wherein both the guide portion and the impact area of the check valve member comprise the magnesia-stabilized zirconia-ceramic material.

7. The nozzle assembly of claim 2, wherein the check valve member comprises the ceria-stabilized zirconia-ceramic material.

8. The nozzle assembly of claim 7, wherein at least the impact area of the check valve member comprises the ceria-stabilized zirconia-ceramic material.

9. The nozzle assembly of claim 8, wherein both the guide portion and the impact area of the check valve member comprise the magnesia-stabilized zirconia-ceramic material.

10. The nozzle assembly of claim 1, wherein the ceramic material is a zirconia-ceramic material.

11. The nozzle assembly of claim 1, wherein the ceramic material has a coefficient of thermal expansion $\alpha > 9\times10^{-6}/°$ C. when averaged over a temperature range of 0° C. to 300° C.

12. The nozzle assembly of claim 11, wherein the ceramic material is a zirconia-ceramic material.

13. The nozzle assembly of claim 1, wherein the ceramic material is a zirconia-ceramic material and has a hardness of less than 13 GPa.

14. The nozzle assembly of claim 13, wherein the zirconia-ceramic material has a hardness of less than 11 GPa.

15. The nozzle assembly of claim 1, wherein the ceramic material has a hardness of less than 12 GPa.

16. The nozzle assembly of claim 15, wherein at least the impact area of the check valve member comprises at least one of a magnesia-stabilized zirconia-ceramic material and a ceria-stabilized zirconia-ceramic material.

17. The nozzle assembly of claim 16, wherein at least the impact area of the check valve member comprises the magnesia-stabilized zirconia-ceramic material.

18. The nozzle assembly of claim 17, wherein both the guide portion and the impact area of the check valve member comprise the magnesia-stabilized zirconia-ceramic material.

19. The nozzle assembly of claim 16, wherein at least the impact area of the check valve member comprises the ceria-stabilized zirconia-ceramic material.

20. The nozzle assembly of claim 16, wherein both the guide portion and the impact area of the check valve member comprise at least one of the magnesia-stabilized zirconia-ceramic material and the ceria-stabilized zirconia-ceramic material.

21. A fuel injector having a fuel injector nozzle assembly comprising:

a nozzle defining a guide bore, a fuel pressure chamber, a seat, and a nozzle orifice; and a check valve member having an impact area and a guide portion slidably disposed in the guide bore between an open position in which the fuel pressure chamber is in fluid communication with the nozzle orifice and a closed position in which the impact area of the check valve member is pressing against the seat of the nozzle and the check valve member is blocking fluid communication between the fuel pressure chamber and the nozzle orifice; and the check valve member comprising a ceramic material having a coefficient of thermal expansion $\alpha > 8\times10^{-6}/°$ C. when averaged over a temperature range of 0° C. to 300° C.

22. The fuel injector of claim 21, the ceramic material having a coefficient of thermal expansion $\alpha > 9\times10^{-6}/°$ C. when averaged over a temperature range of 0° C. to 300° C.

23. The fuel injector of claim 21, wherein the ceramic material is a zirconia-ceramic material and has a hardness of less than 13 GPa.

24. The fuel injector of claim 23, the zirconia-ceramic material having a coefficient of thermal expansion $\alpha > 9\times10^{-6}/°$ C. when averaged over a temperature range of 0° C to 300° C.

* * * * *